US005973305A

United States Patent [19]

Kim et al.

[11] Patent Number: 5,973,305

[45] Date of Patent: Oct. 26, 1999

[54] MICROWAVE OVEN DOOR HAVING A MICROWAVE SHIELDING STRUCTURE

[75] Inventors: Byeong-Jun Kim; Woo-Keum Jun, both of Incheon; Won-Pyo Hong, Kyungki-Do; Sang-Jin Kim, Incheon; Byung-Kap Lim, Seoul; Heung-Dae Kang, Incheon; Jae-Won Cho; Yong-Soo Shin, both of Seoul, all of Rep. of Korea

[73] Assignee: Daewoo Electronics, Co. Ltd., Seoul, Rep. of Korea

[21] Appl. No.: 08/570,474

[22] Filed: Dec. 11, 1995

[30] Foreign Application Priority Data

Sep. 18, 1995 [KR] Rep. of Korea ..... 95-30529

[51] Int. Cl.[6] ..... H05B 6/76

[52] U.S. Cl. ..... 219/742; 174/35 GC

[58] Field of Search ..... 219/741, 742, 219/743, 740; 174/35 R, 35 GC

[56] References Cited

U.S. PATENT DOCUMENTS

| | | | |
|---|---|---|---|
| 3,668,357 | 6/1972 | Kobayashi | 219/741 |
| 4,645,892 | 2/1987 | Gustafsson | 219/742 |
| 4,822,968 | 4/1989 | Chin | 219/741 |
| 4,868,359 | 9/1989 | Iwabuchi et al. | 219/742 |
| 5,206,478 | 4/1993 | Lee | 219/742 |

FOREIGN PATENT DOCUMENTS

| | | | |
|---|---|---|---|
| 2602626 | 2/1988 | France . | |
| 2224661 | 11/1972 | Germany . | |
| 3536589 | 4/1986 | Germany . | |
| 4-10387 | 1/1992 | Japan | 219/742 |
| 4-242097 | 8/1992 | Japan | 219/742 |
| 2249245 | 4/1992 | United Kingdom . | |

*Primary Examiner*—Philip H. Leung
*Attorney, Agent, or Firm*—Smith, Gambrell & Russell, LLP

[57] ABSTRACT

A choke structure of microwave oven door which can effectively protect a human body by shielding the microwave leakage to outside is disclosed. The choke structure comprises a drawn side wall provided by bending from the sealing surface opposite to the front panel, a lower choke wall bent by extending outwards from an end of the drawn side wall, an outer choke wall bending by extending from an end of the lower choke wall toward the sealing surface, and an upper choke wall bent by extending from an end of the outer choke wall toward the drawn side wall. The length of the microwave transmission path is $\frac{1}{4}\lambda_0$ wherein, $\lambda_0$ is the free space wavelength of microwave. The choke structure has a plurality of slits for dividing the choke structure into a plurality of chokes to form plural open longitudinal paths. The holes for reinforcing impedance are formed at portions of the lower choke wall opposite to the slits formed at the choke structure. A large impedance is formed in view of circuitry between the front panel of a cooking chamber and a sealing surface of a door frame contacted thereto. Thus, almost the leaked microwave disappears by short-circuiting at the inner surface of the final short longitudinal surface from the opening of the choke structure as a starting point.

14 Claims, 10 Drawing Sheets

21
23
24
25
26
27
41
42
43
A1
A2
B
C
ℓ'11
ℓ'12
ℓ'2
ℓ'3

MICROWAVE OVEN DOOR HAVING A MICROWAVE SHIELDING STRUCTURE

BACKGROUND OF THE INVENTION

1. Field of the Invention

The present invention relates to a microwave oven door, which can shield (or seal) the leakage of microwave. More particularly, the present invention relates to a microwave oven door having a microwave shielding structure which maximizes the shielding of the microwave leakage to outside by forming a choke structure having a short-circuiting transmission path at an end of a conductor plate, to effectively protect the human body from harmful microwaves.

2. Prior Arts

Generally, home microwave ovens are provided with a magnetron for generating microwaves. In the electric field room of a microwave oven, there is provided a magnetron for generating microwaves. Such microwaves are generated when a high voltage produced by primary and secondary induction coils of a high potential transformer that is attached on a base plate of the electric field room, is stably supplied to the magnetron, the high voltage being generated through the inductive interaction between the induction coils. Such microwaves are irradiated into a cooking chamber of a microwave oven through an irradiating tube. When the microwaves are irradiated into the cooking chamber after passing through the irradiating tube, the food placed within the cooking chamber is heated in order to cooked.

The power supply line of the magnetron mainly consists of a filament, a cathode and an anode. When the high voltage is supplied to the magnetron to generate microwaves, unnecessary microwaves radiating through cathode and filament, i.e., noises and microwaves having basic frequencies which are suitable for heating the food, are generated. Then, the noises flow back through the filament and the cathode, causing wave obstructions in nearby apparatuses.

Because such microwaves are radio waves harmful to human body, its leakage to the outside is prevented while cooking. A door of the microwave oven is provided for withdrawing the cooked food through the front of the cooking chamber. The cooked state of the food can be recognized without opening the door, and the door has a choke structure to prevent leakage of the microwaves even though it is closed.

Conventionally, doors with choke structures are divided into those of one piece-type (1 PC) and two pieces-type (2 PCS). FIG. 9 is a cross-sectional view for showing a conventional door having a 2 PCS-type choke structure, which is attached to a cooking chamber 102 of a microwave oven cavity 101. FIG. 10A is a detailed cross-sectional view for showing the 2 PCS-type choke structure as shown in FIG. 9, in which a microwave absorber is not attached, and FIG. 10B is a detailed cross-sectional view for showing the 2 PCS-type choke structure as shown in FIG. 9, in which a microwave absorber is attached. As shown in the figures, a door having the 2 PCS type choke structure comprises two components consisting of a door frame 105 to form a choke structure (or choke part) 106 and a door screen 104 having perforations. A front panel 103 is provided at the overall peripheral region of an entrance 111 of cooking chamber 102 of microwave oven cavity 101. A door screen 104 having perforations through which the cooked state of food 110 in cooking chamber 102 can be recognized from outside, is formed on the front panel 103. Front panel 103 and a sealing surface 115 formed at the peripheral portion of door screen 104 primarily seals the microwave leakage by the junction between the metal plates. At the overall peripheral region of door screen 104, a door frame 105 is integrally formed by a binding method such as a projection weld 114. Around the end portion of door frame 105, a bending portion 112 as a protruded portion having a rectangular shape, is provided. An opening 113 is provided between bending portion 112 and door screen 104 to form a choke structure 106 inside door frame 105.

As shown in FIG. 10B, a microwave absorber 107 is installed at opening 113. In FIGS. 10A and 10B, $l_1$ and $l_2$ mean each continuous distance between the centers of choke structure 106 consisting of opening 113 and short-circuiting wall 108, respectively. They form a microwave path.

FIGS. 11A and 11B are cross-sectional views for showing a conventional 1 PC-type door. FIG. 11A shows a conventional 1 PC-type choke structure in which a microwave absorber is not attached, and FIG. 11B shows a conventional 1 PC-type choke structure in which a microwave absorber is attached.

As illustrated in the figures, the conventional 1 PC-type door has a door frame 205 having a choke structure 206 as one PC type on a front panel 203 provided at the overall peripheral region of the entrance of a cooking chamber 202. Front panel 203 and the peripheral portion of door frame 205 meet each other (junctioned) via a sealing surface 215 in order to primarily shield the microwave leakage by the junction of metals. As in door frame 104 of 2 PCS-type shown in FIG. 9, door frame 205 has perforations to recognize the cooked state of food in cooking chamber 202, and a bending portion 212 is integrally formed at the peripheral portion of sealing surface 215 so as to have a predetermined height h which meets front panel 203. Inside bending portion 212, a choke structure 206 is provided to prevent the leakage of the microwave which has been primarily shielded by sealing surface 215. At the outer portion of choke structure 213, an opening 213 is formed, in which a microwave absorber 207 is provided. In the 1 PC-type door, the central depth $l_3$ that corresponds to the height h of bending portion 212 forms the microwave path.

The choke structures of 2 PCS- and 1 PC-type door are all based upon the technical idea for decreasing the microwave leakage by allowing the microwave paths 109 and 209 to be $\frac{1}{4}\cdot\lambda_0$($\lambda_0$: free space wavelength of the microwave).

When the characteristic impedance of the short-circuiting transmission path (in the choke structure) is $Z_0$, a path length (which means the length of the microwave path) is 1, and an input impedance from the transmission path entrance (which means the opening of the choke structure) to the end of the path when the end of the path is short-circuited (when short-circuited, the load impedance $Z_L$ is zero) is $Z_{IN}$, a relationship $Z_{IN}=V(l)/I(l)=j\cdot Z_0\cdot \tan \beta l$ (wherein, $\beta=2\pi/\lambda_0$, $\lambda_0$: free space wavelength), is established.

The microwave leakage decreasing apparatuses (shielding apparatus) having the above 1 PC and 2 PCS type, in which the microwave path of the choke structure is determined as $\frac{1}{4}\cdot\lambda_0$, are based upon the principle of achieving the input impedance of the microwave transmission path of 1 PC type door (the distance from opening 213 to the inner surface of a short-circuiting wall 208, l), $|Z_{IN}|=Z_0\cdot\tan\{(2\pi/\lambda_0)(\frac{1}{4}\cdot\lambda_0)\}=\infty$.

Also, as shown in FIG. 10B, the microwave transmission path of the 2 PCS-type door, the input impedance at opening 113 of choke structure 106 $|Z_{IN}|=\infty$ is achieved by allowing the central continuous distance from opening 113 of choke structure 106 to the inner surface of short-circuiting wall 108, $1_1+1_2$ to be $\frac{1}{4}\cdot\lambda_0$, There are several problems in the above 1 PC and 2 PCS type doors.

Firstly, the size of the choke structure is large. More particularly, the microwave transmission path is restricted to the depth of choke structure 206 in case of 1 PC type door, and therefore the size of bending portion 205 of the door should be large. In 2 PCS type door, the microwave transmission path consists of the central continuous distance of choke structure 106, $1_1+1_2$. Therefore, since the microwave transmission path is limited by the depth and length of choke structure 106, the choke structure of the 2 PCS type door can be formed smaller than that of 1 PC type door. However, there is still a limit in reducing the choke size while maintaining the microwave transmission path as $\frac{1}{4}\cdot\lambda_0$. Therefore, it is difficult to achieve a compact door.

Secondly, due to the insufficient microwave decreasing ability, additional microwave absorbers 107 and 207 are necessary. For example, two components of door screen 104 and door frame 105 are integrally formed by a method such as projection weld 114 to form a primary sealing surface 115 in the 2 PCS type door. During the welding process, a welding residue remains or deformation of the conductive surface due to the heat occurs on the primary sealing surface 115 so that the smoothness of door screen 104 becomes degraded. Therefore, not only the primary sealing effect is degraded but it is also difficult to form choke structure 106 having the accurate dimension via the welding process of the two conductors, and therefore, the microwave reducing ability decreases. Thus, expensive components such as microwave absorber 107 are necessary.

Thirdly, the productivity of the door is low. In the 1 PC type door, choke structure 206 is formed by only setting the depth of choke structure 206. When the microwave wavelength is considered, the choke structure that has a drawing shape of about 30 mm depth at the peripheral region of the conductor plate is very difficult to manufacture. Also, in the 2 PCS type door, two components are integrally formed via hard works such as dimension controlling, welding controlling, etc. and thus its productivity becomes very low.

Fourthly, providing the choke structure is expensive. As mentioned above, additional components such as microwave absorbers 107 and 207 are necessary and also its productivity is lowered due to the difficulties in the manufacturing process thereof, which results in high cost.

Meanwhile, a microwave ovens choke structure having a G-shaped profile is described in U.S. Pat. No. 4,645,892 (issued to Jan A. C. Gustafsson). FIG. 12A is a sectional view of an oven cavity 310 with a door 319 having the above choke structure disclosed in the above U.S. patent, and FIG. 12B is an enlarged view of the choke structure as illustrated in FIG. 12A.

At the front of a front panel 318, door 319 is provided parallel. A choke 320 is made by folding of a pre-punched sheet and has a G-shaped profile as shown in FIG. 12B. The microwave transmission path L starts from an inner portion 327, via an input opening 326, and past a partition wall 323), to a short-circuiting wall 324 and its length is $\frac{1}{2}\cdot\lambda$ (wherein $\lambda$ is the wavelength) long. The microwave disappears through the U-shaped path inside the choke.

In the choke structure described in the above U.S. patent, a partition wall should be provided with transverse slots to decrease microwave leakage. Further, it is difficult to determine the size of the choke structure because the microwave transmission path leads from the inner portion 327 of the sealing surface in order to have a $\frac{1}{2}\cdot\lambda$ length. That is, according to above U.S. Patent, the choke structure may be constructed in either a very small size or a very large size.

SUMMARY OF THE INVENTION

The present invention is intended to overcome the above described disadvantages. Therefore, it is an object of the present invention to provide a microwave oven door having a microwave shielding structure which can maximize the shielding of the microwave leakage to outside so as to effectively protect the human body from harmful microwaves.

For achieving the above object, the present invention provides

A microwave oven door, comprising:

a door screen having perforations for enabling one to recognize a cooked state of a food;

a sealing surface for firstly shielding a microwave leakage, the sealing surface being formed around a peripheral region of the door screen, and the sealing surface being junctioned with an overall peripheral region of a front panel formed at an entrance of a cooking chamber of a microwave oven cavity; and a door frame having a choke structure for secondarily shielding a microwave which has leaked between the sealing surface and the front panel, the door frame being integrally formed by extending the sealing surface, and wherein the choke structure comprises: a drawn side wall which is formed by bending from the sealing surface opposite to the the front panel, a lower choke wall which is formed by bending and extending outward from an end of the drawn side wall, an outer choke wall which is formed by bending and extending from an end of the lower choke wall toward the sealing surface, and an upper choke wall which is formed by bending and extending from an end of the outer choke wall toward the drawn side wall, and at least two discontinuous transmission paths from a first opening which is formed between the end of the upper choke wall and the drawn side wall are formed to form a microwave transmission path whose length is $\frac{1}{4}.\lambda_0$, wherein $\lambda_0$ is a free space microwave wavelength.

According to one embodiment of the present invention, the choke structure comprises: a partition wall which is protrudingly formed by extending inward the choke structure from the end of the upper choke wall, and the microwave transmission path comprises a first transmission path formed from the first opening to an inner surface of the lower choke wall, a second transmission path formed from a second opening to an inner surface of the outer choke wall, the second opening being formed from an end of the partition wall to the lower choke wall, and a third transmission path formed from a third opening to an inner surface of the upper choke wall, the third opening being formed from the end of the partition wall to the outer choke wall. The choke structure comprises a plurality of slits for forming a plurality of open transmission paths by dividing the choke structure into a plurality of chokes, and the slits are traversely formed by crossing the choke structure, which is formed at the overall peripheral region of the door frame. Further, a plurality of holes each having either a circular or a rectangular shape, are formed at portions of the lower choke wall opposite to the slits formed at the choke structure, for improving both an input impedance of the open transmission paths and a characteristic impedance between each of the open transmission paths.

According to another embodiment of the present invention, the first transmission path consists of a primary first short-circuiting transmission path and a secondary first short-circuiting transmission path, and the primary first short-circuiting transmission path is formed by the drawn side wall and the partition wall and starts from the first opening and the secondary first short-circuiting transmission path starts at the end of partition wall and is formed by the outer choke wall and the drawn side wall. The choke structure comprises a plurality of slits for forming a plurality of open transmission paths by dividing the choke structure into a plurality of chokes, and the slits are traversely formed by crossing the choke structure, which is formed at the overall peripheral region of the door frame. The slits are continuously formed at the upper choke wall and the outer choke wall.

Several bending portions are formed at the choke structure of the door so as to form a plurality of discontinuous short-circuited paths, and the choke structure is divided into a plurality of chokes by forming a plurality of slits so as to form a plurality of longitudinal transmission paths. By forming the impedance reinforcing holes in the slit portions between two chokes, an impedance that is large in view of the circuitry, is obtained between the front panel of the cooking chamber and the sealing surface of door frame, whose surface meets the surface of the front panel. Hence, the microwave leakage disappears as microwaves are led from the first opening to the surface of the final short-circuiting wall, and so are short-circuited.

BRIEF DESCRIPTION OF THE DRAWINGS

The above objects and other advantages of the present invention will become more apparent by describing in detail a preferred embodiment thereof with reference to the attached drawings, in which.

DESCRIPTION OF THE PREFERRED EMBODIMENT

Hereinafter, the present invention will be described in detail, with reference to the accompanying drawings.

Figure 1:
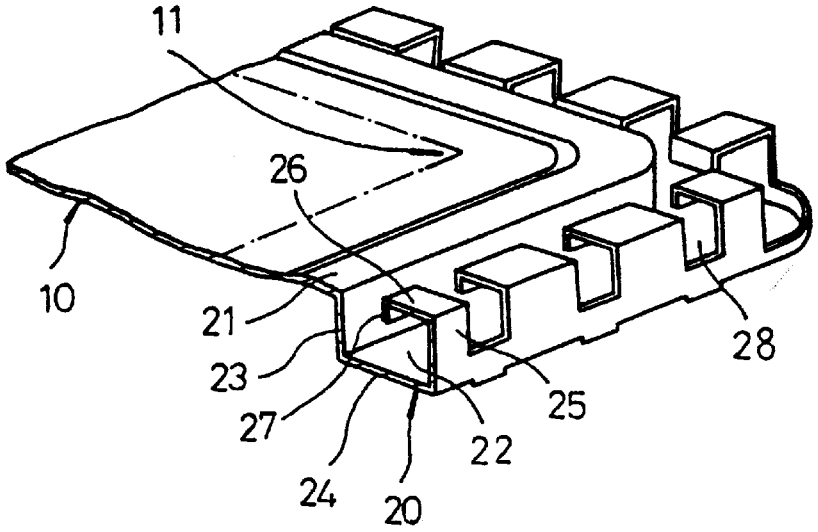
FIG. 1 is a schematic perspective view of a choke structure as a microwave shielding structure for a microwave oven door according to one embodiment of the present invention.
Figure 2:
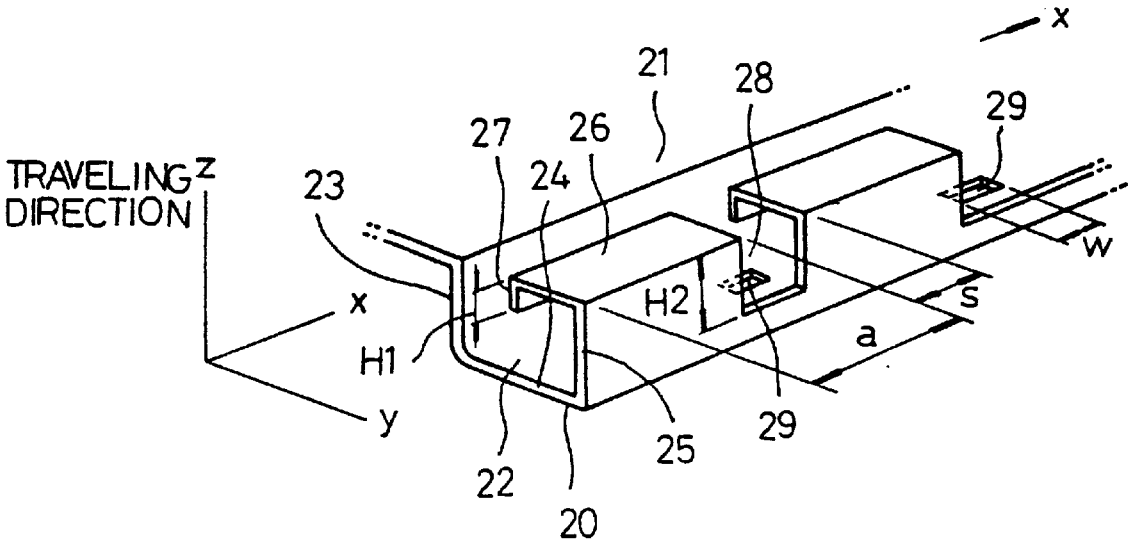
FIG. 2 is a detailed perspective view of the choke structure as shown in FIG. 1.
Figure 9:
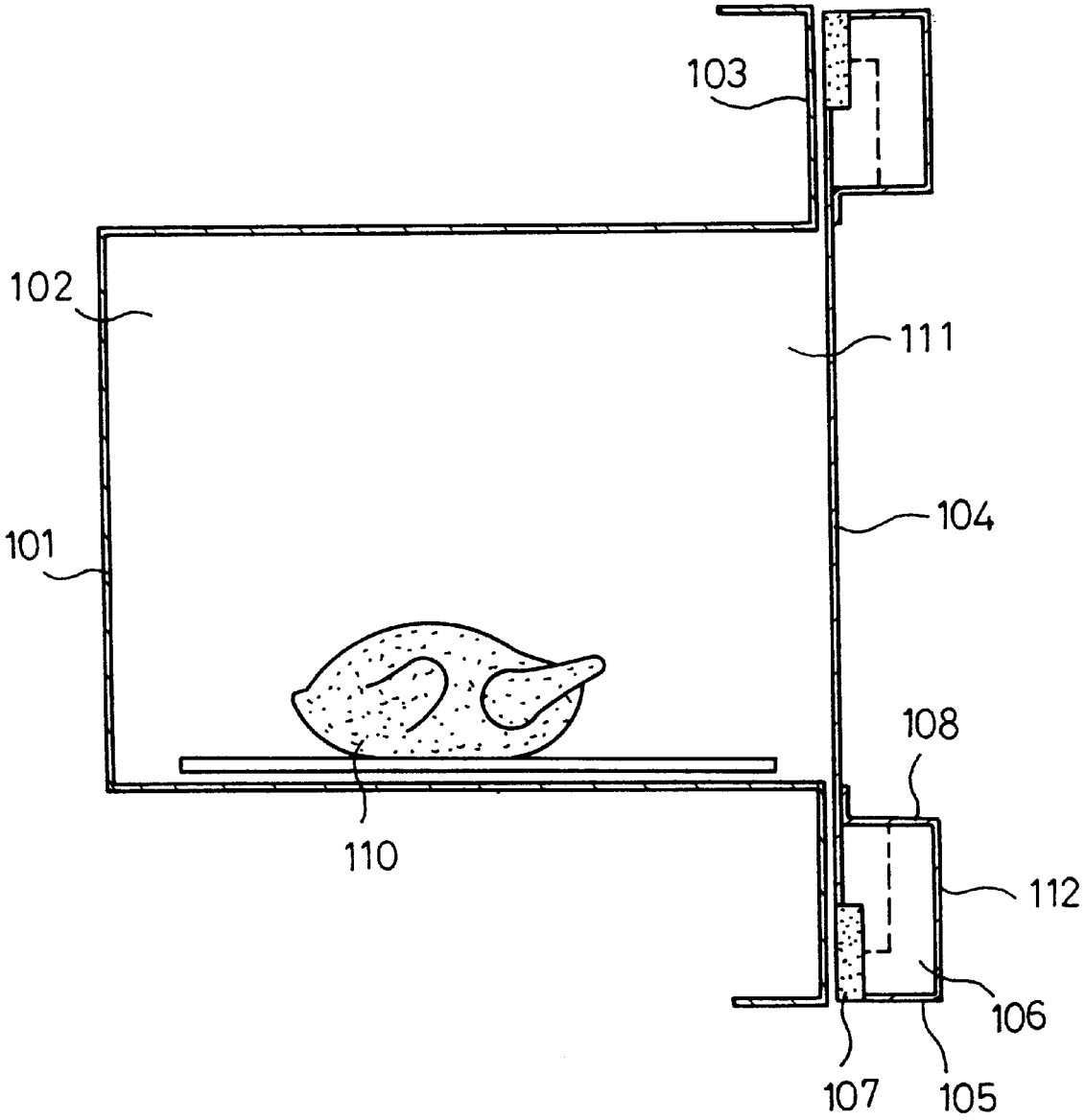
FIG. 9 (PRIOR ART)
FIG. 9 is a cross-sectional view for showing a conventional door having a 2 PCS-type choke structure, which is attached to the cooking chamber of a microwave oven cavity.
Figure 10B:
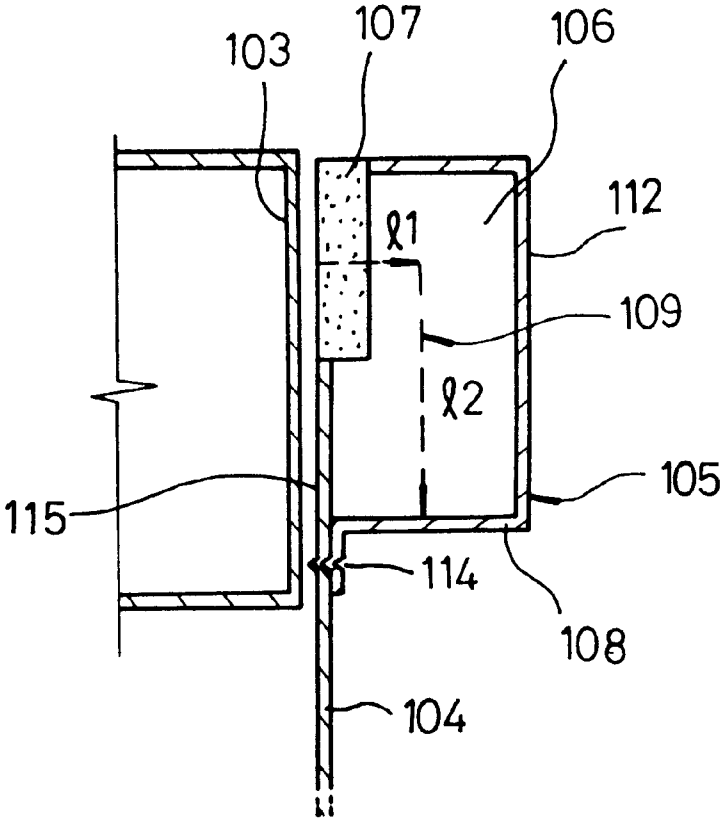
FIG. 10B (PRIOR ART)
FIG. 10B is a detailed cross-sectional view for showing the 2 PCS-type choke structure as shown in FIG. 9, in which a microwave absorber is attached.
Figure 10A:
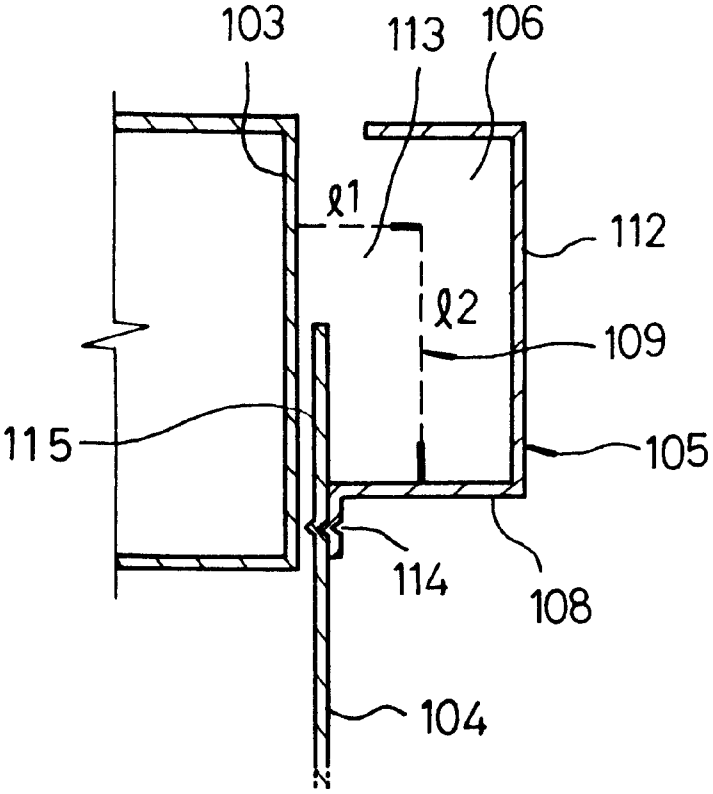
FIG. 10A (PRIOR ART)
FIG. 10A is a detailed cross-sectional view for showing the 2 PCS-type choke structure as shown in FIG. 9 in which a microwave absorber is not attached.
Figure 11B:
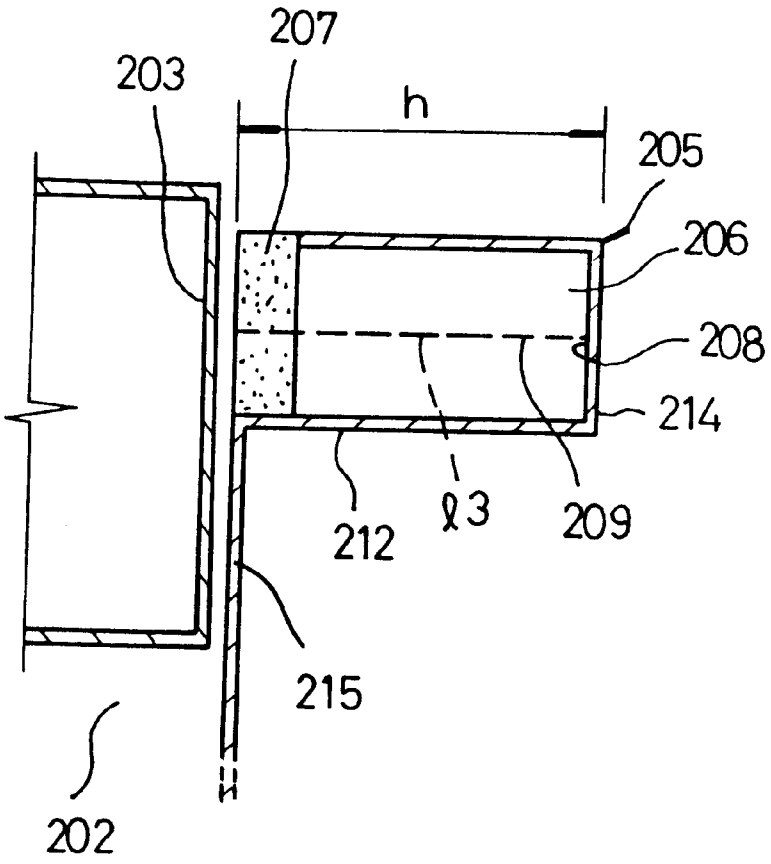
FIG. 11B (PRIOR ART)
FIG. 11B is a cross-sectional view for showing a conventional 1 PC-type choke structure in which a microwave absorber is attached.
Figure 11A:
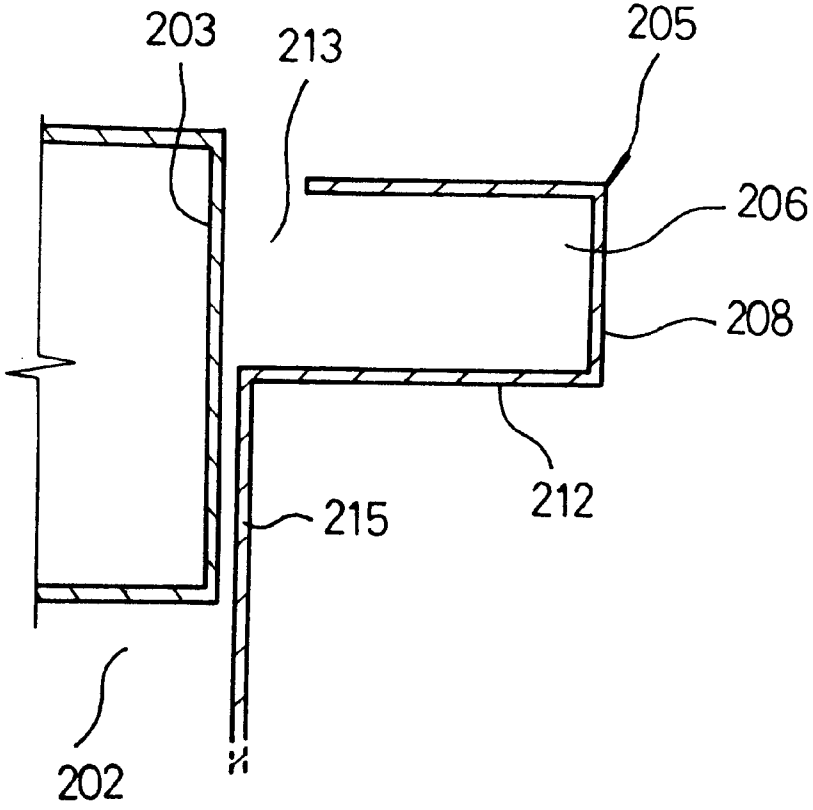
FIG. 11A (PRIOR ART)
FIG. 11A is a cross-sectional view for showing a conventional 1 PC-type choke structure in which a microwave absorber is not attached.
Figure 12B:
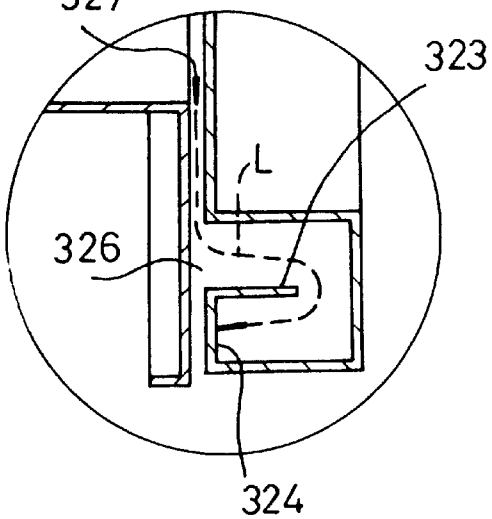
FIG. 12B (PRIOR ART)
FIG. 12B is an enlarged view of the choke structure in FIG. 12A.
Figure 12A:
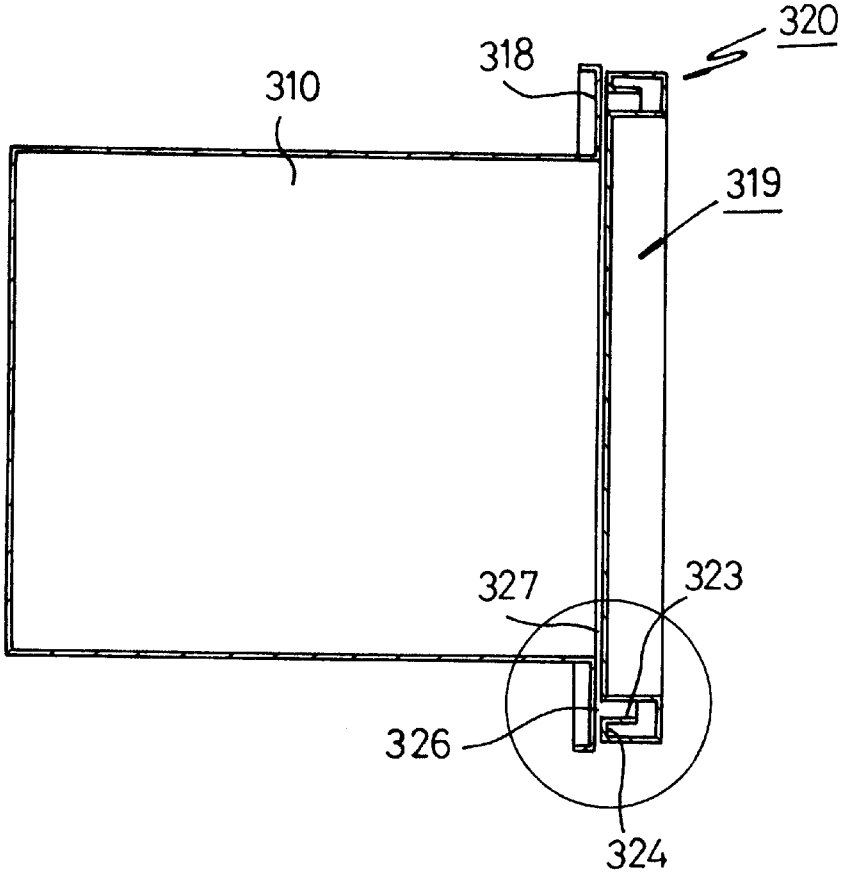
FIG. 12A (PRIOR ART)
FIG. 12A is a sectional view of an oven cavity with a door having a conventional choke structure with a G-shaped profile microwave transmission path.

FIG. 1 is a schematic perspective view of a choke structure as a microwave shielding structure for a microwave oven door according to one embodiment of the present invention. FIG. 2 is a detailed perspective view of the choke structure as shown in FIG. 1. As illustrated in the figures, at the front portion of a microwave oven cavity (101 in FIG. 9), a front panel is provided along the circumference (the peripheral portion) of a cavity 101 and a microwave oven door is attached to the front panel. The microwave oven door has a door frame 20, wherein a door screen 10 is formed at the middle (or central) region and a choke structure 22 is formed at the peripheral region. Perforations 11 for enabling one to recognize the cooked state of food are formed at the peripheral region of door screen 10. A sealing surface 21 is formed at the peripheral region of door frame 20 which is located at the outer circumference region of door screen 10 primarily for preventing microwave leakage from the microwave oven by closely adhering to the front panel (3 in FIGS. 3A and 3B and 103 in FIG. 9). A drawn side wall 23 is formed by extending sealing surface 21 so that it is perpendicularly bent from sealing surface 21 towards outside (opposite to the front panel). A lower choke wall 24 is formed by integrally extending from an end of drawn side wall 23 and by perpendicularly bending it outwards (opposite to a door screen 10). An outer choke wall 25 is formed by perpendicularly bending from the end of lower choke wall 24 and integrally extending it toward sealing surface 21. An upper choke wall 26, as a short-circuiting wall, is formed by perpendicularly bending an end of outer choke wall 25 and extending it toward sealing surface 21. A partition wall 27 is formed by perpendicularly bending an end of a choke upper wall 26 and bending it toward the inside of the choke structure.

Referring to FIG. 2, a plurality of slits 28 are formed at outer choke wall 25, at upper choke wall 26 and at partition wall 27 of choke structure 22 to provide a plurality of open transmission paths. Slits 28 are traversely formed by crossing choke structure 22, which is formed along the overall peripheral region of door frame 20 so that choke structure 22 is divided into a plurality of chokes. As illustrated in the figures, slits 28 are continuously formed at partition wall 27, at upper choke wall 26, and at outer choke wall 25.

As shown in FIG. 2, impedance reinforcing holes 29 are formed at portions of lower choke wall 24, which face slits 28, between a choke and an adjacent choke. In the present embodiment, impedance reinforcing holes 29 are formed in a rectangular shape, but in another embodiment, these may be formed in a circular shape.

The width (S) and the depth ($H_2$) of slits 28, the choke width (a) in choke structure 22, and the width (W) of impedance reinforcing hole 29 relate to the structural strength of door frame 20 and to the degree of the microwave leakage shielding. These dimensions are determined by appropriately considering such aspects. The depth $H_2$ of slits 28 formed at outer choke wall 25 of choke structure 22, is preferably greater than the height (or the depth) $H_1$ of partition wall 27, which protrudes from upper choke wall 26. Also, it is preferable that the width (a) of the chokes divided by slits 28 is smaller than $\frac{1}{4}\cdot\lambda_0$ and the width (S) of slits 28 is not more than $\frac{2}{3}\cdot(a)$. The width (W) of impedance reinforcing hole 29 is preferably not more than the width (S) of slits 28.

Referring to FIG. 2, saying that microwave transmission directions are x, y and z directions, then the width (a) of choke structure 22 and the width S of slits 28, which are gaped in the x direction of choke structure 22 and continuously formed in the y direction at partition wall 27, at upper choke wall 26, and at outer choke wall 25, is determined under such conditions so as to prevent the microwave leakage in the x direction. Slits 28 form an appropriate microwave transmission field by forming a plurality of open transmission paths in the x directions. Therefore, the impedance of choke structure 22 in the x direction increases. Further, impedance reinforcing holes 29 increase the impedance by decreasing the area between two opposing conductor surfaces, i.e. the front panel (103 in FIG. 9) of the cooking chamber and lower choke wall 24, which opposes slits 28 of upper choke wall 26.

As mentioned above, the microwave leakage prevention effect is enhanced by increasing the characteristic impedance of each of the open transmission paths as well as by increasing the input impedance of each of the transmission paths formed in the x direction.

Figure 3B:
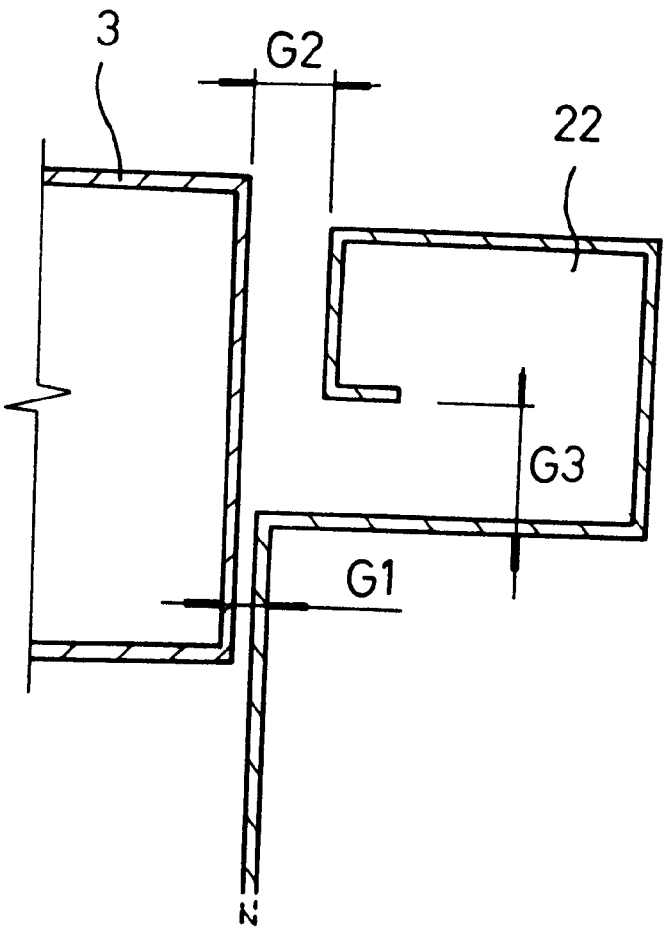
FIG. 3B is a view for explaining the attached state of the choke structure as shown in FIG. 3A.
Figure 3A:
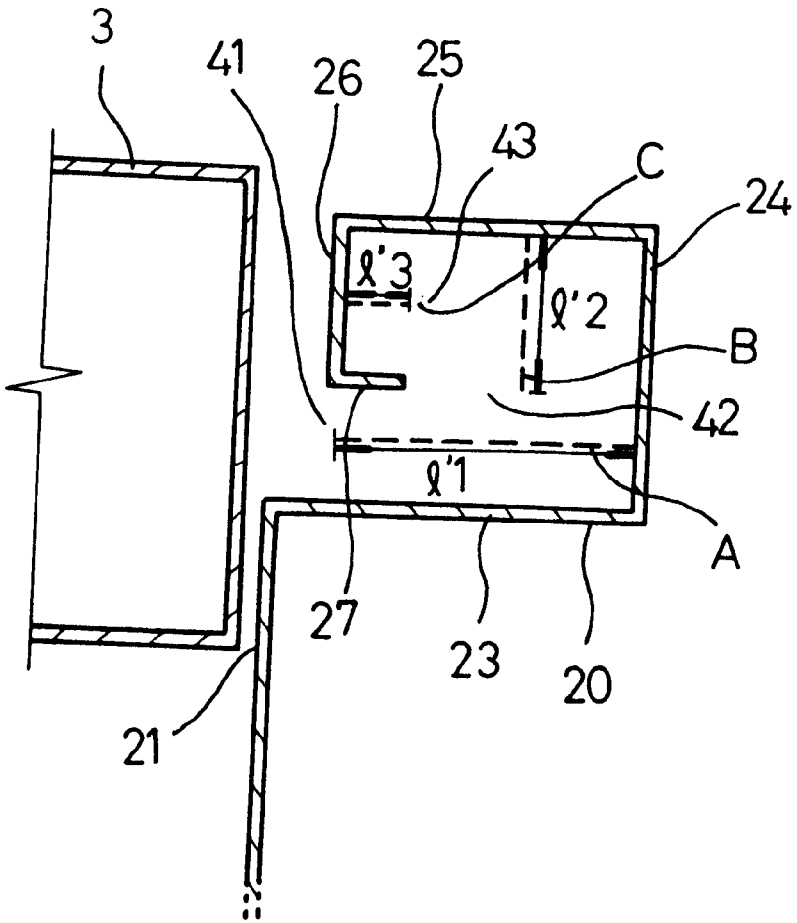
FIG. 3A is a sectional view for illustrating the state in which the choke structure as shown in FIGS. 1 and 2 is attached to a front panel, and for showing microwave transmission paths.
Figures 4A, 4B, 4C:
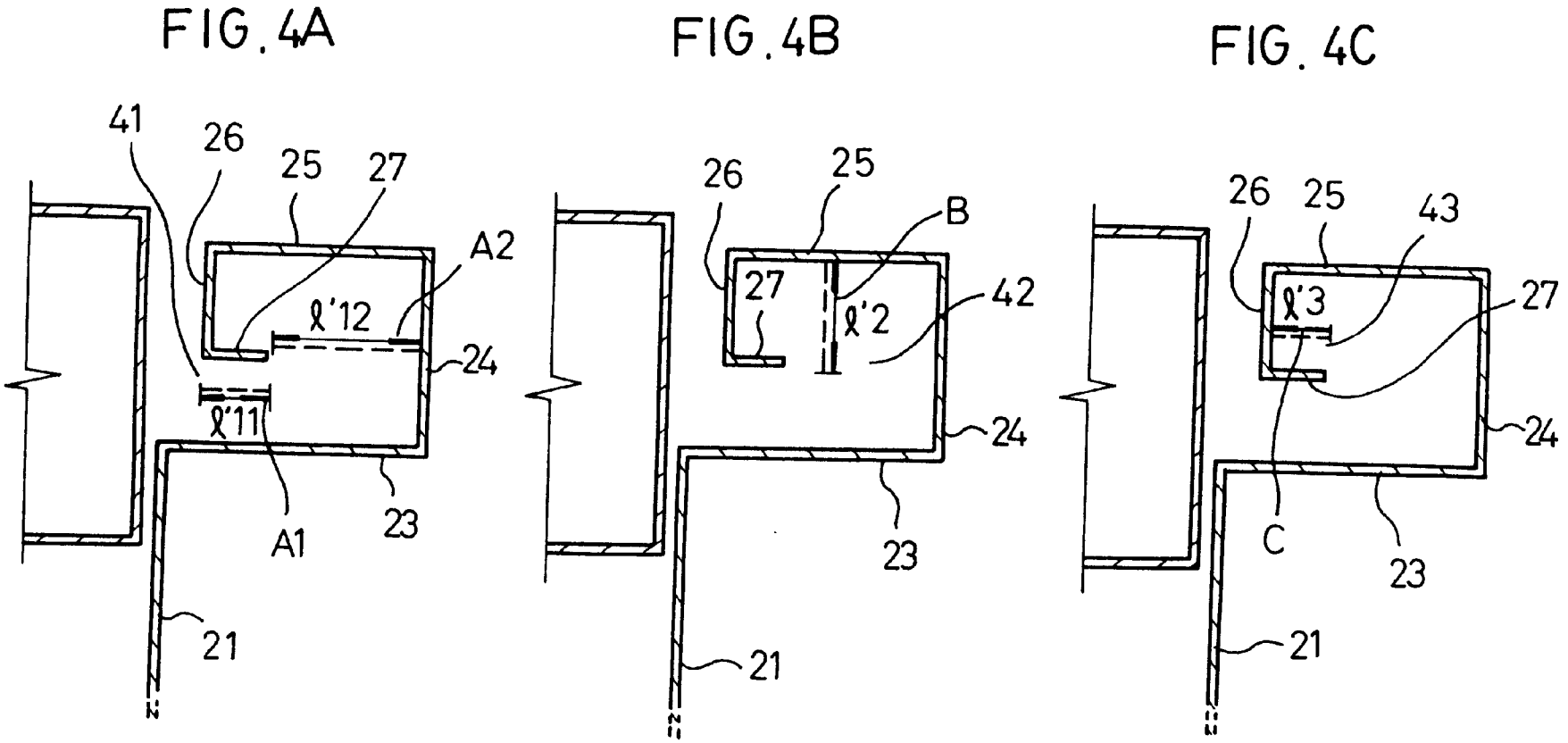
FIGS. 4A, 4B and 4C respectively are sectional views of the choke structure for illustrating each of the microwave transmission paths as shown in FIGS. 3A and 3B.

FIG. 3A is a sectional view for illustrating the microwave transmission paths, wherein the choke structure as shown in FIGS. 1 and 2 is attached to front panel 3, and FIG. 3B is a view for explaining in detail the attached state of the choke structure as shown in FIG. 3A. FIGS. 4A, 4B and 4C respectively are also sectional views of the choke structure for illustrating each of the microwave transmission paths as shown in FIGS. 3A and 3B.

As illustrated in FIG. 3A, a first short-circuiting transmission path (A) having the length of $l'_1$, a second short-circuiting transmission path (B), having the length of $l'_2$ and a third short-circuiting transmission path (C), having the length of $l'_3$ are formed in choke structure 22 according to the present embodiment. As shown in FIG. 4A, the first short-circuiting transmission path (A) leads from a first opening 41, a starting point which is formed between drawn side wall 23 and the end of upper choke wall 26, and which consists of a primary first short-circuiting transmission path (A1) and a secondary first short-circuiting transmission path (A2). The primary first short-circuiting transmission path (A1), having length of $l'_{11}$, is formed by drawn side wall 23 and partition wall 27. The secondary first short-circuiting transmission path (A2) having length of $l'_{12}$ starts at the end of partition wall 27, and is formed by outer choke wall 25 and drawn side wall 23. The first short-circuiting transmission path (A) having the length of $l'_1(=l'_{11}+l'_{12})$ starts at first opening 41, which is formed by partition wall 27 having length of $l'_{11}$ (which corresponds to height $H_1$ in FIG. 2) and the inner surface of drawn side wall 23, and reaches the inner side of lower choke wall 24 as, the short-circuiting surface. As shown in FIG. 3, the first short-circuiting transmission path (A) is formed by extending the center line of first opening 41 from first opening 41 to the inner surface of lower choke wall 24. In other words, the transmission path in the first short-circuiting transmission path (A) is formed by drawn side wall 23, partition wall 27 and outer choke wall 25.

The second short-circuiting transmission path (B) starts at second opening 42 as a starting point, which is formed by the end of partition wall 27 and the inner surface of lower choke wall 24 and has a length of $l'_{12}$, and reaches the inner surface of outer choke wall 25, as the short-circuiting surface, and the second shortcircuiting path (B) is formed by extending the center line of second opening 42. The transmission path of the second short-circuiting transmission path (B) is formed by lower choke wall 24 and upper choke wall 26. The third short-circuiting transmission path (C) starts at third opening 43 as a starting point, which is formed by the end of partition wall 27 and the inner surface of outer choke wall 25, reaches the inner surface of upper choke wall 26 as short-circuiting surface, and is formed by extending the center line of third opening 43. The transmission path in the third short-circuiting transmission path (C) is formed by outer choke wall 25 and partition wall 27.

The microwave path of the choke structure consists of the first short-circuiting transmission path (A), the second short-circuiting transmission path (B) and the third short-circuiting transmission path (C), and the sum of these path's lengths $(l'_{11}+l'_{12}+l'_2+l'_3)$ is $\frac{1}{4}\cdot\lambda_0$.

Referring to FIG. 3B, the junction distance between sealing surface 21 and front panel 3 is represented as $G_1$; the distance between upper choke wall 26 and front panel 3 is represented as $G_2$; and the size of first opening 41 in FIG. 3A, i.e. the distance between partition wall 27 and drawn side wall 23, is represented as $G_3$. Preferably, the junction distance $G_1$ between sealing surface 27 and front panel 3 is as short as possible, while still providing the microwave shielding effect. Although it is impossible to remove the junction distance $G_1$ because of the structure of a microwave oven structure, $G_1$ is preferably less than 1.0 mm. The distance $G_2$ between front panel 3 and upper choke wall 26 is preferably as short as possible, while a component such as a gasket for preventing any contamination or such as a decoration structure is allowed to be attached to the front panel.

Hereinafter, the microwave shielding mechanism will be described in detail referring to FIGS. 4A, 4B and 4C.

When a microwave leaks through the gap between front panel 3 and sealing surface 21, which has a distance of $G_1$ in FIG. 3B, the leaked microwave travels from first opening 41 as a starting point via the primary first short-circuiting transmission path (A1), which has a length of $l'_{11}$ and is formed by drawn side wall 23 and partition wall 27, and the secondary first short-circuiting transmission path (A2), which has a length of $l'_{12}$ and is formed by drawn side wall 23 and outer choke wall 25, as shown in FIG. 4A. Then, the leaked microwave reaches the inner surface of lower choke wall 24 via first short-circuiting transmission path (A1), whose length is $l'_{11}+l'_{12}$. Then, as shown in FIG. 4B, the microwave reaches the inner surface of outer choke wall 25 after travelling the second short-circuiting transmission path (B), which has a length of $l'_2$ which starts from second opening 42 as a starting point, and is formed by lower choke wall 24 and upper choke wall 26. Thereafter, as shown in FIG. 4C, the microwave reaches the inner surface of upper choke wall 26, which is the final short-circuiting surface, via the third short-circuiting transmission path (C) which has a transmission path with the length of $l'_3$, starts from third opening 43, and is formed by outer choke wall 25 and partition wall 27. Finally, the length of the microwave transmission path becomes $l=(l'_{11}+l'_{12})+l'_2+l'_3=\frac{1}{4}\cdot\lambda_0$.

Figure 5B:
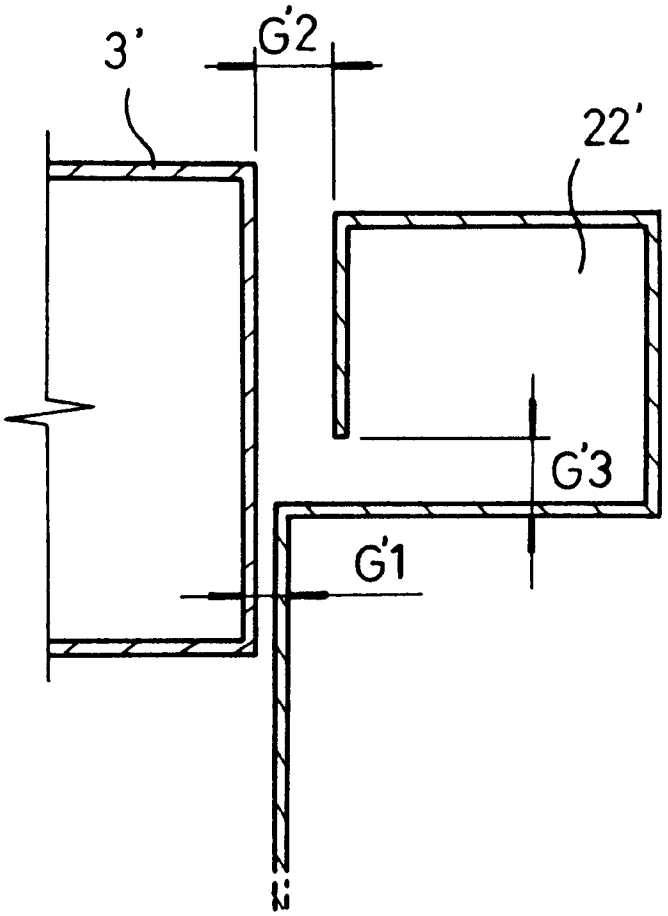
FIG. 5B is a view for explaining the attached state of the choke structure as shown in FIG. 5A.
Figure 5A:
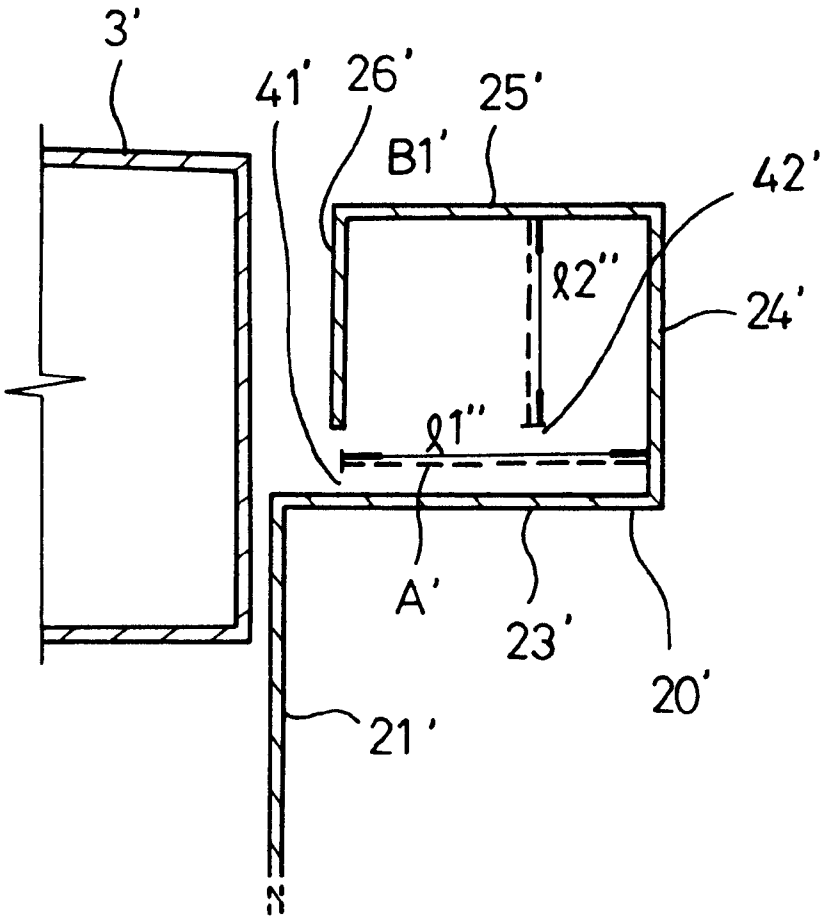
FIG. 5A is a sectional view for illustrating a microwave transmission path, wherein the choke structure according to the second embodiment of the present invention is attached to a front panel.
Figure 6B:
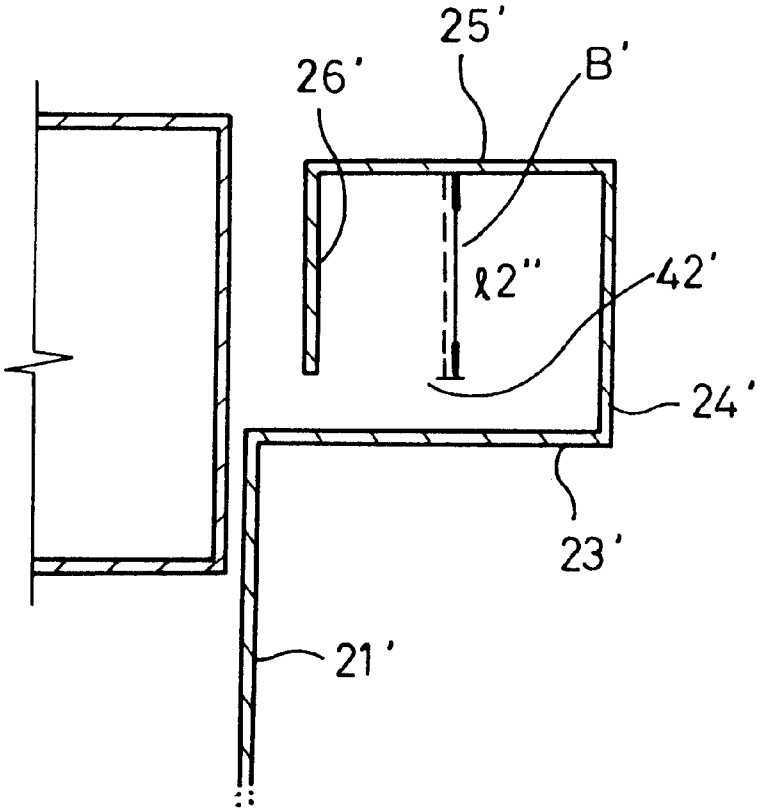
FIGS. 6A and 6B respectively are sectional views of the choke structure, for illustrating the microwave transmission path as shown in FIGS. 5A and 5B.
Figure 6A:
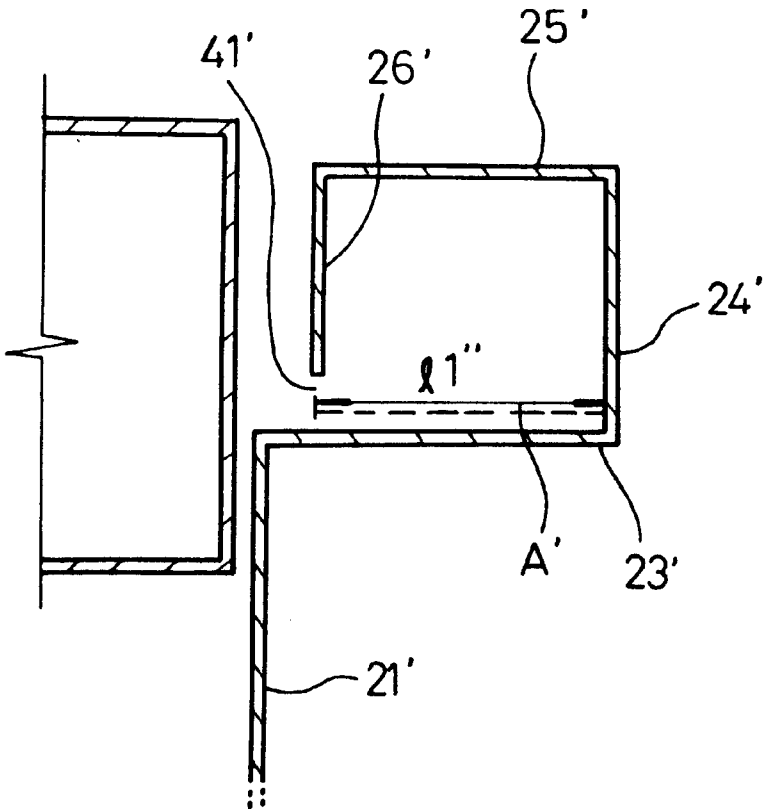

FIGS. 5A, 5B, 6A and 6B respectively are cross-sectional views of the choke structure in a microwave oven according to another embodiment. FIG. 5A is a sectional view for illustrating a microwave transmission path, wherein the choke structure according to this embodiment is attached to a front panel 3', and FIG. 5B is a view for explaining the attached state of the choke structure as shown in FIG. 5A. FIGS. 6A and 6B respectively are sectional views of the choke structure for illustrating the microwave transmission path as shown in FIGS. 5A and 5B.

The choke structure according to this embodiment is the same as that in the first embodiment illustrated in FIGS. 1 and 2, except that the partition wall is omitted by forming an upper choke wall 26 longer than the upper choke wall of the first embodiment. By omitting a partition wall while maintaining the same overall microwave transmission path in the choke structure as in the first embodiment through elongation of the upper choke wall in the second embodiment, the productivity is enhanced, since not only is the same shielding ability maintained, but the manufacturing process also is simpler.

As illustrated in FIG. 4A, a first short-circuiting transmission path (A') having a length of $l''_1$, and a second short-circuiting transmission path (B') having a length of $l''_2$ are formed in a choke structure 22' according to the second embodiment. As shown in FIG. 6, the first short-circuiting transmission path (A') having a length of $l''_1$, starts from a first opening 41' and is formed by a drawn side wall 23' and an outer choke wall 25'. The first short-circuiting transmission path (A') having a length of $l''_1$, starts from first opening 41' which is formed by the end of upper choke wall 26' and drawn side wall 23', and travels to the inner surface of a lower choke wall 24', the short-circuiting surface. Further, the first shortcircuiting transmission path (A') is formed by extending the center line of first is opening 41' from first opening 41' to the inner surface of lower choke wall 24'. This first short-circuiting transmission path (A') is formed by drawn side wall 23' and outer choke wall 25'. The second short-circuiting transmission path (B') starts from a second opening 42' which is formed by the end of upper choke wall 26' and a lower choke wall 24', and has a length of $l''_1$, and travels to the inner surface of outer choke wall 25', the short-circuiting transmission surface. The second short-circuiting transmission path (B') is also formed by extending the center line of second opening 42'. This second short-circuiting transmission path (B') is formed by lower choke wall 24' and upper choke wall 26'.

Though they are not shown in the figures, as illustrated in FIGS. 1 and 2, slits may be formed at the choke structure. The slits can be formed continuously at upper choke wall 26' and outer choke wall 25'. As shown in FIG. 2, impedance reinforcing holes 29 as the impedance reinforcing holes in the first embodiment may be formed in the second embodiment. Any further explanation for the slits and the impedance reinforcing holes will be omitted because the explanation is the same as the explanation for the first embodiment.

The microwave transmission path of the choke structure consists of the first short-circuiting transmission path (A') and the second short-circuiting transmission path (B'). The sum of the lengths of these paths $(l''_1+l''_2)$ is $\frac{1}{40}\cdot\lambda_0$.

Referring to FIG. 5B, as in FIG. 3B, the junction distance between a sealing surface 21' and a front panel 3' is represented as $G'_1$; the distance between upper choke wall 26' and front panel 3' is represented as $G'_2$; and the size of the first opening in FIG. 5A, i.e. the distance between the end of upper choke wall 26' and drawn side wall 23', is represented as $G'_3$. The explanation for $G'_1$, $G'_2$ and $G'_3$ is the same as for $G_1$, $G_2$ and $G_3$ in FIG. 3B. Thus, any further explanation for them will be omitted.

Hereinafter, the microwave shielding mechanism will be described in detail referring to FIGS. 6A and 6B.

When a microwave leaks through the gap between front panel 3' and sealing surface 21', a gap with a distance $G'_1$ in FIG. 4B, the leaked microwave reaches the inner surface of lower choke wall 24' by starting from first opening 41' and then travelling through the first short-circuiting transmission path (A'), which has a length of $l''_1$ and is formed by drawn side wall 23' and outer choke wall 25', as illustrated in FIG. 6A. Then, as shown in FIG. 6B, the microwave reaches the inner surface of upper choke wall 26', which is the final short-circuiting plane, by starting from second opening 41' and then travelling through the second short-circuiting transmission path (B'), which has a length of $l''_2$ and is formed by lower choke wall 24' and upper choke wall 26'. The length l of the microwave transmission path is as follows: $l=l''_1+l''_2=\frac{1}{4}\cdot\lambda_0$.

Figure 7:
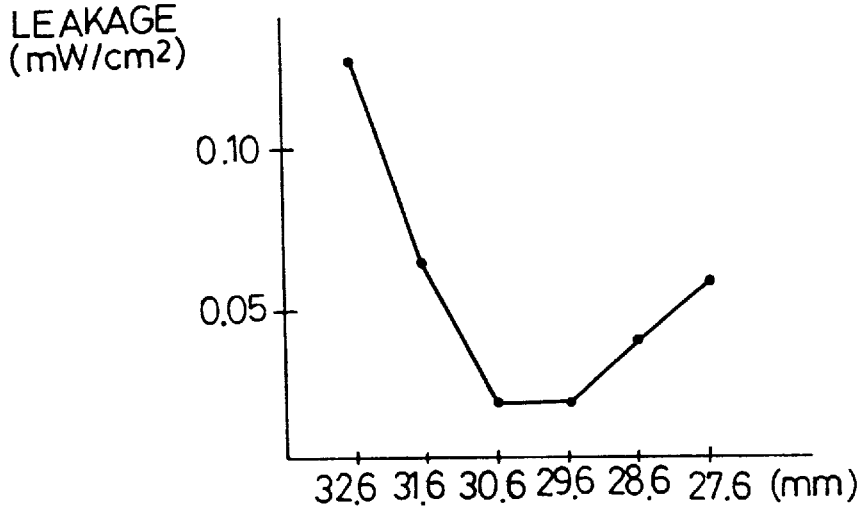
FIG. 7 is a graph for showing the microwave leakage measured according to changes in the length of the microwave transmission path.

The microwave oven door having the choke structure as shown in FIGS. 1 and 2 was manufactured. The microwave leakage was measured under the state without water load with respect to changes in the size of the first opening and to the changes in the length of the microwave transmission path. At first, while fixing the junction distance $G_1$ between the sealing surface and the front panel at 0.5 mm, and while fixing the distance $G_2$ between the upper choke wall and the front panel at 3.0 mm, the microwave leakage was measured by changing the length of microwave transmission path l from 27.6 mm to 32.6 mm. FIG. 7 is a graph showing the measured microwave leakage (the vertical axis) with respect to the length (the horizontal axis) of the microwave transmission path. As can be noted from the figure, the microwave leakage appears to be at a minimum when the length of microwave transmission path is in the range of 29.6 mm to 30.6 mm. Therefore, it is preferable to set the length of the microwave transmission path as above, since this length obtains an excellent microwave shielding effect.

Figure 8:
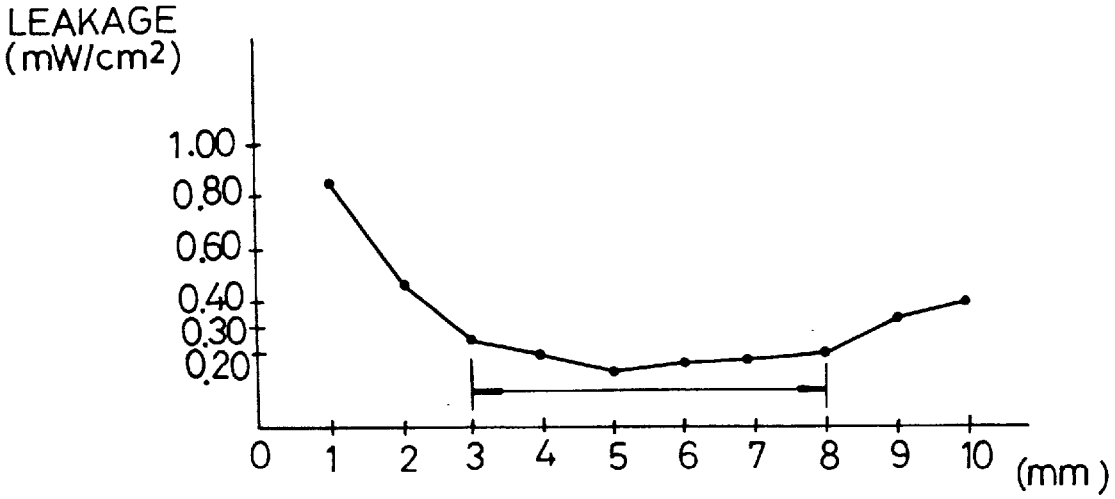
FIG. 8 is a graph for showing the microwave leakage measured according to changes in the size of the first opening.

Secondly, while fixing the junction distance $G_1$ between the sealing surface and the front panel at 1.0 mm, and while fixing the distance $G_2$ between the upper choke wall and the front panel at 3.0 mm, the microwave leakage was measured under the state without water load while changing the size of the first opening $G_3$, i.e. the distance between the partition wall and the drawn side wall, from 1 mm to 10 mm. FIG. 8 is a graph showing the measured microwave leakage (the vertical axis) with respect to the size (the horizontal axis) of the first opening. As noted from the figure, it appears that the microwave leakage is at a minimum when the size of the first opening is in the range of 3 mm to 8 mm. Therefore, it is preferable to set the size of the first opening in this range so that an excellent microwave shielding effect may be obtained.

As mentioned above, according to the microwave shielding structure of the microwave oven of the present invention, a plurality of discontinuous short-circuited paths are formed by forming several bending portions in the choke structure of a door frame. Furthermore, a plurality of open transmission paths are formed by dividing the choke structure into a plurality of chokes with a plurality of slits. By forming the impedance reinforcing holes at the slit portions between the chokes, a large impedance in circuitry can be obtained between the front panel of the cooking chamber and the sealing surface of the adjacent door frame. Therefore, an excellent microwave shielding effect can be obtained without any additional microwave absorbing material, and the microwave leakage shielding can be maximized to protect the human body from harmful microwaves.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A microwave oven door, comprising:

a door screen having perforations for enabling one to recognize a cooked state of a food;

a sealing surface for firstly shielding a microwave leakage, said sealing surface being formed around a peripheral region of said door screen, and said sealing surface being junctioned with an overall peripheral region of a front panel formed at an entrance of a cooking chamber of a microwave oven cavity; and a door frame having a choke structure for secondarily shielding a microwave which has leaked between said sealing surface and said front panel, said door frame being integrally formed by extending the sealing surface, and wherein said choke structure comprises: a drawn side wall which is formed by bending from said sealing surface opposite to the said front panel, a lower choke wall which is formed by bending and extending outward from an end of said drawn side wall, an outer choke wall which is formed by bending and extending from an end of the lower choke wall toward said sealing surface, and an upper choke wall which is formed by bending and extending from an end of said outer choke wall toward said drawn side wall, at least two discontinuous transmission paths from a first opening which is formed between the end of said upper choke wall and said drawn side wall are formed to form a microwave transmission path whose length is $\frac{1}{4}.\lambda_0$, wherein $\lambda_0$ is a free space microwave wavelength, said choke structure comprises a plurality of slits for forming a plurality of open transmission paths by dividing the choke structure into a plurality of chokes, and the slits are traversely formed by crossing said choke structure, which is formed at the overall peripheral region of said door frame, and a plurality of holes each having either a circular or a rectangular shape, are formed at portions of said lower choke wall opposite to the slits formed at said choke structure, for improving both an input impedance of the open transmission paths and a characteristic impedance between each of the open transmission paths.

2. The microwave oven door as claimed in claim 1, wherein said choke structure comprises: a partition wall which is protrudingly formed by extending inward said choke structure from the end of said upper choke wall, and said microwave transmission path comprises a first transmission path formed from the first opening to an inner surface of said lower choke wall, a second transmission path formed from a second opening to an inner surface of said outer choke wall, the second opening being formed from an end of the partition wall to said lower choke wall, and a third transmission path formed from a third opening to an inner surface of said upper choke wall, the third opening being formed from the end of said partition wall to said outer choke wall.

3. The microwave oven door as claimed in claim 2, wherein the slits are continuously formed at said partition wall, at said upper choke wall and at said outer choke wall, and a depth of the slits formed at said outer choke wall is not larger than a height of said partition wall which protrudes from said upper choke wall.

4. The microwave oven door as claimed in claim 2, wherein a width of a choke formed between a slit and an adjacent slit is smaller than one-fourth of the free space microwave length.

5. The microwave oven door as claimed in claim 2, wherein widths of the holes are not larger than a width of said slits.

6. The microwave oven door as claimed in claim 2, wherein the first transmission path consists of a primary first short-circuiting transmission path and a secondary first short-circuiting transmission path, and the primary first short-circuiting transmission path is formed by said drawn side wall and said partition wall and starts from the first opening and the secondary first short-circuiting transmission path starts at the end of partition wall and is formed by said outer choke wall and said drawn side wall.

7. The microwave oven door as claimed in claim 1, wherein the microwave transmission path comprises: a first transmission path formed from the first opening to an inner surface of said lower choke wall, and a second transmission path formed from a second opening to said outer choke wall, the second opening being formed from an end of said upper choke wall to said lower choke wall.

8. The microwave oven door as claimed in claim 7, wherein the slits are continuously formed at said upper choke wall and said outer choke wall.

9. The microwave oven door as claimed in claim 7, wherein a width of a choke formed between a slit and an adjacent slit is smaller than one-fourth of the free space wavelength.

10. The microwave oven door as claimed in claim 7, wherein a width of the holes is not larger than that of said slit.

11. The microwave oven door as claimed in claim 1, wherein a length of the microwave path is between about 29.6 mm and about 30.6 mm.

12. The microwave oven door as claimed in claim 1, wherein a size of the first opening is about 3 mm to about 8 mm.

13. A microwave oven door, comprising:

a door screen having perforations for enabling one to recognize a cooked state of a food;

a sealing surface for firstly shielding a microwave leakage, said sealing surface being formed around a peripheral region of said door screen, said sealing surface being junctioned with an overall peripheral region of a front panel formed at an entrance of a cooking chamber of a microwave oven cavity; and a door frame having a choke structure for secondarily shielding a leaked microwave which has leaked between said sealing surface and said front panel, said door frame being integrally formed by extending the sealing surface, wherein said choke structure comprises: a drawn side wall which is formed by bending from said sealing surface opposite to the said front panel, a lower choke wall which is formed by bending and extending outward from an end of said drawn side wall, an outer choke wall which is formed by bending and extending from an end of the lower choke wall toward said sealing surface, an upper choke wall which is formed by bending and extending from an end of said outer choke wall toward said drawn side wall, and a partition wall which is protrudingly formed by extending inward said choke structure from the end of said upper choke wall, and a microwave transmission path of said choke structure comprises: a first transmission path formed from a first opening to an inner surface of said lower choke wall, the first opening being formed from a first opening formed between the end of said upper choke wall and said drawn side wall, a second transmission path formed from a second opening to an inner surface of said outer choke wall, the second opening being formed from an end of the partition wall to said lower choke wall, and a third transmission path formed from a third opening to an inner surface of said upper choke wall, the third opening being formed from the end of said partition wall to said outer choke wall, and the microwave transmission path is $\frac{1}{4}.\lambda_0$, wherein $\lambda_0$ is a free space microwave wavelength, said choke structure comprises a plurality of slits for forming a plurality of open transmission paths by dividing the choke structure into a plurality of chokes, the slits being traversely formed by crossing said choke structure which is formed at the overall peripheral region of said door frame, and the slits are continuously formed at said partition wall, at said upper choke wall and at said outer choke wall, a depth of the slits formed at said outer choke wall is not larger than a height of said partition wall which protrudes from said upper choke wall, a width of a choke formed between a slit and an adjacent slit is smaller than one-fourth of the free space microwave length, and a plurality of holes, each having a circular or a rectangular shape, are formed at portions of said lower choke wall opposite to the slits formed at said choke structure, for improving both an input impedance of the open transmission paths and a characteristic impedance between each open transmission paths, where the widths of the holes are not larger than a width of said slits.

14. A microwave oven door, comprising:

a door screen having perforations for enabling one to recognize a cooked state of a food;

a sealing surface for firstly shielding a microwave leakage, said sealing surface being formed around a peripheral region of said door screen, said sealing surface being junctioned with an overall peripheral region of a front panel which is formed at an entrance of a cooking chamber of a microwave oven cavity; and a door frame having a choke structure for secondarily shielding a leaked microwave which has leaked between said sealing surface and said front panel, said door frame being integrally formed by extending the sealing surface, wherein said choke structure comprises a drawn side wall which is formed by bending from said sealing surface opposite to the said front panel, a lower choke wall which is formed by bending and extending outward from an end of said drawn side wall, an outer choke wall which is formed by bending and extending from an end of the lower choke wall toward said sealing surface, and an upper choke wall which is formed by bending and extending from an end of said outer choke wall toward said drawn side wall, and a microwave transmission path of said choke structure comprises a first transmission path formed from a first opening to an inner surface of said lower choke wall, the first opening being formed between an end of said upper choke wall, and a second transmission path formed from a second opening to said outer choke wall, the second opening being formed from an end of said upper choke wall to said lower choke wall, said choke structure comprises a plurality of slits for forming a plurality of open transmission paths by dividing the choke structure into a plurality of chokes, the slits being traversely formed by crossing said choke structure which is formed at the overall peripheral region of said door frame, the slits are continuously formed at said upper choke wall and said outer choke wall, a width of a choke formed between a slit and an adjacent slit is smaller than one-fourth of the free space microwave length, and a plurality of holes, each having a circular or a rectangular shape, are formed at portions of said lower choke wall opposite to the slits formed at said choke structure, for improving both an input impedance of the open transmission paths and a characteristic impedance between each open transmission paths, where the widths of the holes are not larger than a width of said slits.

* * * * *